United States Patent [19]

Müller et al.

[11] Patent Number: 5,076,152

[45] Date of Patent: Dec. 31, 1991

[54] APPARATUS FOR VENTILATION AND REMOVAL OF AIR

[75] Inventors: Gottfried Müller; Paul Hipp, both of Kolbingen, Fed. Rep. of Germany

[73] Assignee: Schako Metallwarenfabrik Ferdinand Schad KG, Kolbingen, Fed. Rep. of Germany

[21] Appl. No.: 466,506

[22] Filed: Jan. 17, 1990

[30] Foreign Application Priority Data

Jan. 20, 1989 [DE] Fed. Rep. of Germany ..... 3901543
Jan. 20, 1989 [DE] Fed. Rep. of Germany ..... 3901544

[51] Int. Cl.[5] ..... F24F 13/06
[52] U.S. Cl. ..... 454/245; 454/305
[58] Field of Search ..... 98/32, 33.1, 104, 114, 98/40.18

[56] References Cited

U.S. PATENT DOCUMENTS 688,132 12/1901 Sims ..... 98/104
1,177,779 4/1916 Kerch ..... 98/104
1,329,802 2/1920 Scherer ..... 98/104

FOREIGN PATENT DOCUMENTS 149203 7/1885 European Pat. Off. ..... 98/40.18

*Primary Examiner*—Harold Joyce
*Attorney, Agent, or Firm*—Bachman & LaPointe

[57] ABSTRACT

The apparatus includes a housing box and a partition therein separating a supply air space from an exhaust air space, with both spaces being connected to a supply air line and an exhaust air line via corresponding connecting pieces.

7 Claims, 3 Drawing Sheets

APPARATUS FOR VENTILATION AND REMOVAL OF AIR

The invention relates to an apparatus for the ventilation and removal of air from, in particular, living areas or similar, having a housing box.

At present living areas are ventilated and air is removed via separate supply air grilles and exhaust air grilles. As a rule, the exhaust air grille is located on an outside wall, with the result that the exhaust air can be discharged directly into the open air. Ventilation, on the other hand, usually takes place via ceiling grilles which have a corresponding connection to an air-conditioning system or similar.

The disadvantage of this arrangement is that, on the one hand, separate openings have to be made for supply air and exhaust air, which not only necessitates an increased amount of work but also impairs the visual appearance of a room. The use of separately provided supply air grilles and exhaust air grilles also entails an increased amount of work.

The inventors have set themselves the objective of simplifying the ventilation and removal of air from living areas, in particular, and of making the design more visually appealing.

This object is achieved as a result of the fact that in the housing box a collecting space for supply air is arranged separated by a wall from a space for exhaust air, both spaces being connected to a supply air line and an exhaust air line respectively via corresponding connecting pieces.

As a result, the ventilation and removal of air from a room is carried out by a single device, i.e. a single or uniform supply air and exhaust air grille. Also, only one opening needs to be created in the living area, with the result that the work required for an additional opening is not necessary. Moreover, this apparatus according to the invention is very easy to install and considerably reduces the installation time. It should be stressed, in particular, that the combined supply air and exhaust air grille according to the invention is also suitable for subsequent installation. The supply air and exhaust air grille is provided with corresponding colors, which means that it can be very well matched to the individual living areas.

The space for the exhaust air has exhaust air slots facing towards the living area. The exhaust air passes through these exhaust air slots into the space and is then passed on via the corresponding connecting piece to an exhaust air line. Within the scope of the present invention there is no restriction on the design of the exhaust air slots. However, additional devices for adjusting the flow and for better visual design might be possible.

In a simple exemplary embodiment the exhaust air slots are punched in a sheet-metal strip.

The supply air is preferably discharged from the collecting space to the living area via nozzles. In the exemplary embodiment shown the nozzles are inserted into the sheet-metal strip in a row next to the exhaust air slots. However, a different arrangement is also conceivable here. It is essential, on the other hand, that the nozzle axes of the individual nozzles should have different positions with respect to each other. If the nozzles are arranged in a row, for example, it is recommended that the outer nozzles are inclined towards the outside while the inner nozzles are spread towards the left or right. In this way, a widely dispersed jet of supply air is achieved. There is no limit to the number of nozzles.

The nozzles also make it possible for the supply air to be brought into a living area at a faster rate even if the quantity of air per individual nozzle is relatively small. This also results in the feeding in of the supply air in no event being interrupted by the withdrawal of the exhaust air through the exhaust air slots. For this reason supply air grilles and exhaust air grilles can be used without hesitation in the same apparatus.

In a further exemplary embodiment of the invention the exhaust air space opens towards the outside via a nozzle. Such a nozzle has the considerable advantage that the dirty exhaust air is blown well away from the facade, with the result that the facade is no longer made dirty. It is also for this reason that this nozzle is inserted in a surface of an insert and projects accordingly beyond the facade. As a result of the nozzle opening the exhaust air can be blown well away from the blow-out opening with relatively little ventilator force. Such blowing out of the exhaust air furthermore also has the advantage that the supply air for the living area can also be introduced directly next to the blow-out nozzle without, for example, exhaust air which has already been blown out being sucked in again. Therefore, according to the invention, the supply air space opens towards the outside via supply air intake openings.

These supply air intake openings are preferably covered over by punched strips in order to prevent rain, for example, from being sucked in at the same time.

With regard to the guidance of the supply air line and the exhaust air line it is proposed, on the one hand, that these are adjacent to each other. In this way a degree of heat exchange can take place at the walls, so that the considerably warmer exhaust air can heat up the cooler supply air. This is improved even further, of course, if, according to the invention, the exhaust air line is guided in the supply air line as this increases the area of heat exchange.

The outstanding features of this apparatus according to the invention, comprising exhaust air nozzle and supply air intake opening, are the more simple installation and the avoidance of the facade being made dirty.

Further advantages, features and details of the invention can be seen from the following description of preferred embodiments, as well as with reference to the drawing, in which.

Figure 1:
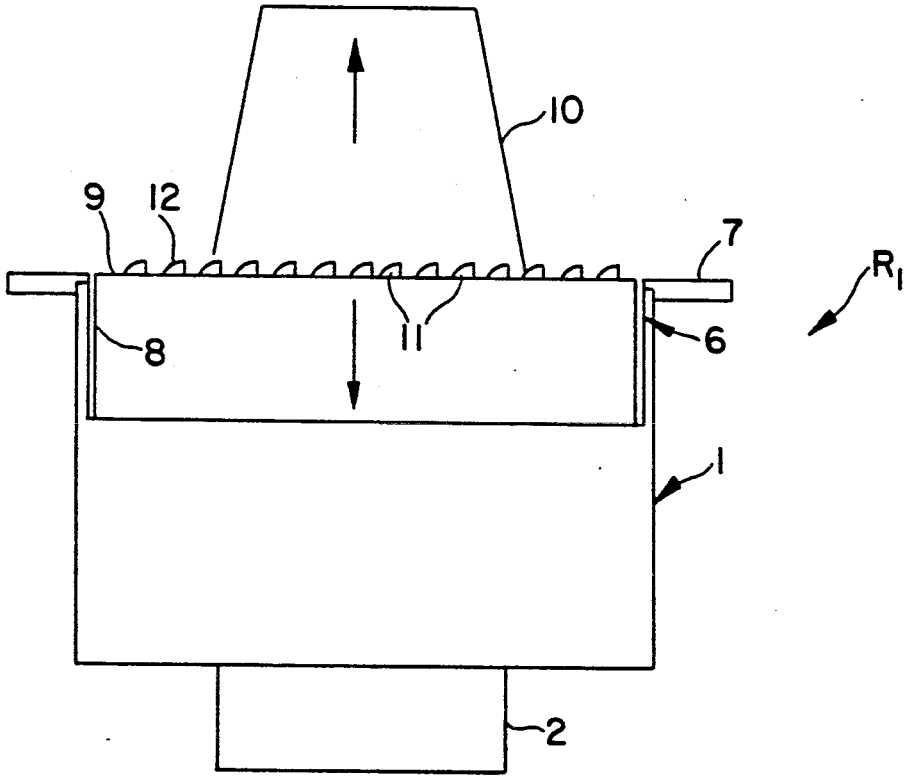
FIG. 1 shows a cross-section through a combined exhaust air grille with supply air intake openings.
Figure 2:
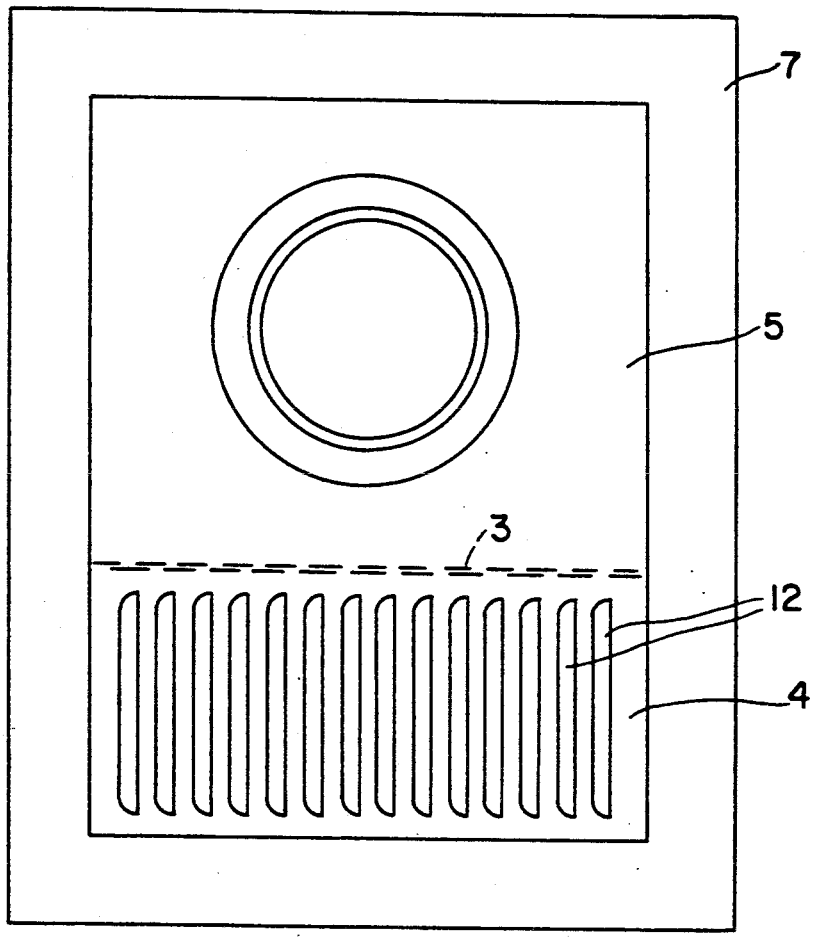
FIG. 2 shows a plan view of the exhaust air grille with supply air intake openings according to FIG. 1.

A combined exhaust air grille $R_1$ with supply air intake opening according to FIG. 1 has a housing box 1, which has at one end connecting pieces 2 for exhaust air and, (not shown), for supply air. Said housing box 1 encloses a space, which is divided by means of a partition 3 (represented in FIG. 2 by broken lines) into a supply air space 4 and an exhaust air space 5.

At the other end of the connecting pieces 2 a frame 6 is inserted into the housing box 1, the frame 6 forming on the one hand a covering strip 7 and on the other an insert 8. Said insert 8 has a surface 9, into which are inserted or molded on the one hand a nozzle 10 for the discharge of exhaust air and on the other hand supply air intake openings 11 for the intake of supply air.

The supply air intake openings 11 are covered over with a corresponding punched strip 12.

Figure 3:
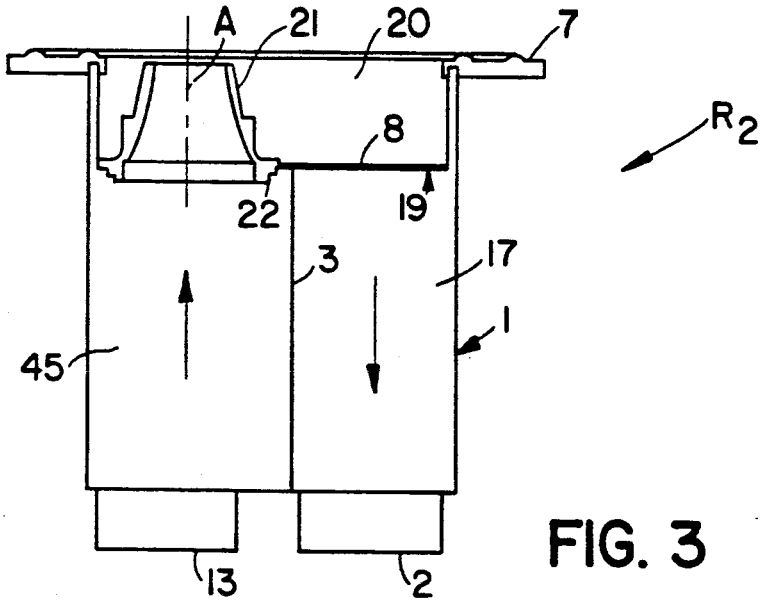
FIG. 3 shows a cross-section through a further exemplary embodiment of a combined supply air and exhaust air grille.

The supply air and exhaust air grille $R_2$ according to the invention and FIG. 3 also has a housing box 1, which is inserted into a stable covering frame 7. One of the purposes of said covering frame 7 is to mask the supply air and exhaust air grille, for example when inserted into the ceiling of a living area.

Towards the rear the housing box 1 has two connecting pieces 2 and 13, it being possible for supply air to be brought into a collecting space 15 of the housing box 1 via the connecting piece 13. The collecting space 15 is divided off in the housing box 1 by the partition 3 from a further space 17, into which exhaust air passes through corresponding exhaust air slots 18. Said space 17 opens out in the connecting piece 2.

For the sake of simplicity, the exhaust air slots 18 are punched into a sheet-metal strip 19, which seals off the collecting space 15 and space 17 towards the interior of the living area and is connected at the sides with the covering frame 7. In the present exemplary embodiment this sheet-metal strip 19 is designed, predominantly for visual reasons, in a U-shape in its cross-section, with the result that the exhaust air slots 18 are located in a depression 20 in the supply air and exhaust air grille $R_2$.

In a row next to the exhaust air slots 18 four outlet nozzles 21 are arranged, which are also recessed in the depression 20.

Each outlet nozzle has an annular groove 22, with which a corresponding edge strip of a punched opening of the sheet-metal strip 19 engages in the operating position.

Figure 4:
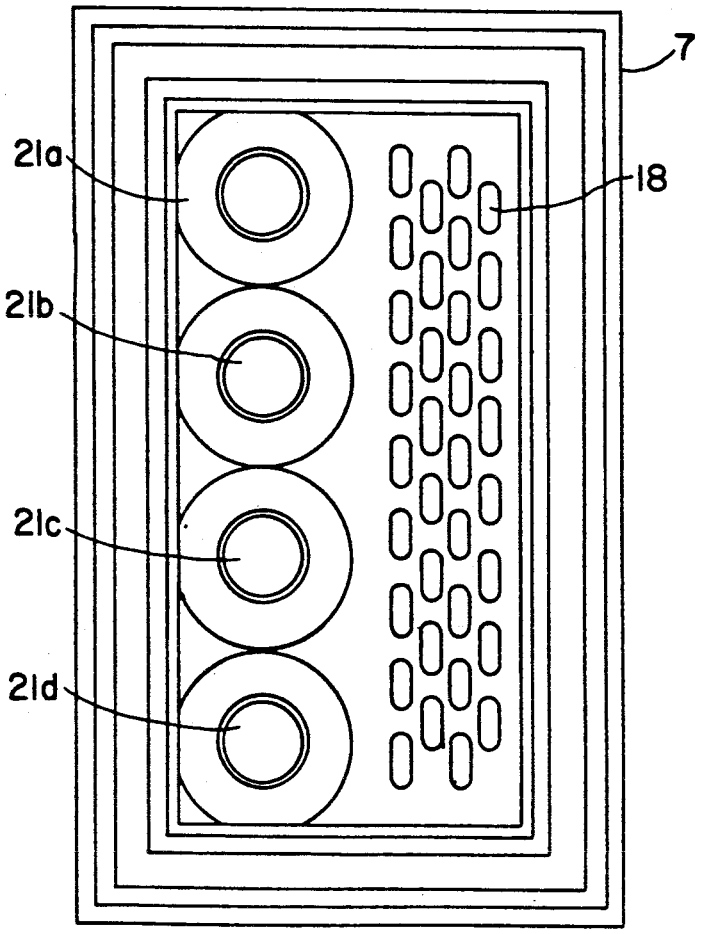
FIG. 4 shows a plan view of the combined supply air and exhaust air grille according to FIG. 3.

FIG. 4 shows that each nozzle 21 has a nozzle axis A arranged in parallel with the others. In the preferred embodiment of the invention, however, each nozzle 21 should have a different blow-out angle. Preferably, the two outer nozzles 21*a* and 21*d* in the plan view should be inserted into the sheet-metal strip 19 spread towards the top and towards the bottom and the two central nozzles 21*b* and 21*c* spread towards the left and towards the right. It is also possible within the scope of the invention for only two nozzles to be inserted, or, however, more than four. There is no upper limit to the number.

What is important is the position of the nozzles with respect to each other, so that the jet streams of the nozzles do not touch each other during blowing out and, above all, the entire living area is well flushed through with supply air. Altogether a widely dispersed jet of supply air is created, which consists of a relatively small quantity of air per individual nozzle yet penetrates far into the room and thus enables the supply air to be guided optimally and evenly over the entire room area. As a result of the nozzles the supply air reaches a corresponding speed, with the result that the supply air is not disturbed by the exhaust air slots 18 arranged nearby in the same grille $R_2$.

The exhaust air slots 18 may be provided with known devices for quantity adjustment. Moreover, the entire housing box 1 is designed to be insulated for purpose of sound and heat insulation.

We claim:

1. Apparatus for the ventilation and removal of air from a space, especially living areas, which comprises: a housing box containing a supply air space and an exhaust air space, said spaces having a forward end; a partition in the housing box separating the supply air space from the exhaust air space; means for connecting a supply air line to the supply air space and means for connecting an exhaust air line to the exhaust air space; and a sheet metal U-shaped strip adjacent the forward end of the spaces forming a depression adjacent said spaces, at least one opening in said depression communicating with the supply air space for introduction of supply air including a member selected from the group consisting of supply air intake openings and at least one air supply nozzle, and at least one opening in said depression communicating with the exhaust air space for removal of exhaust air including a member selected from the group consisting of at least one exhaust air nozzle and exhaust air slots.

2. Apparatus for the ventilation and removal of air from a space, especially living areas, which comprises: a housing box containing a supply air space and an exhaust air space, said spaces having a forward end; a partition in the housing box separating the supply air space from the exhaust air space; means for connecting a supply air line to the supply air space and means for connecting an exhaust air line to the exhaust air space; wherein said exhaust air space includes a member selected from the group consisting of at least one exhaust air nozzle and exhaust air slots on the forward end thereof for removal of exhaust air, and wherein said supply air space includes a member selected from the group consisting of supply air intake openings and at least one air supply nozzle on the forward end thereof for introduction of supply air, provided that when the exhaust air space includes at least one nozzle the supply air space shall include intake openings, and when the exhaust air space includes slots the supply air space shall include at least one nozzle.

3. The apparatus of claim 2 wherein the exhaust air space includes at least one nozzle and said nozzle is inserted into a surface of an insert and projects beyond a facade.

4. The apparatus of claim 2 wherein the supply air intake openings are covered over by punched strips.

5. The apparatus of claim 2 including a supply air line and exhaust air line adjacent to each other.

6. The apparatus of claim 2 wherein the exhaust air space includes exhaust air slots and wherein said exhaust air slots are punched out of a sheet metal strip.

7. The apparatus of claim 6 including a plurality of supply air nozzles, wherein said nozzles are inserted in said sheet metal strip in a row next to the exhaust air slots.

* * * * *